US006938691B2

(12) United States Patent
Face

(10) Patent No.: US 6,938,691 B2
(45) Date of Patent: Sep. 6, 2005

(54) PORTABLE GROUNDWATER SAMPLING SYSTEM

(76) Inventor: Royce J. Face, 3774 Oregon Rd., Ottawa, KS (US) 66067

( * ) Notice: Subject to any disclaimer, the term of this patent is extended or adjusted under 35 U.S.C. 154(b) by 239 days.

(21) Appl. No.: 10/456,456

(22) Filed: Jun. 6, 2003

(65) Prior Publication Data

US 2004/0244965 A1 Dec. 9, 2004

(51) Int. Cl.[7] ..... E21B 49/08; G01N 1/14

(52) U.S. Cl. ..... 166/264; 166/67; 73/152.23; 73/864.34

(58) Field of Search ..... 166/264, 67, 370, 166/105, 107; 73/152.23, 864.34, 864.54, 864.51

(56) References Cited

U.S. PATENT DOCUMENTS

| | | | | | |
|---|---|---|---|---|---|
| 4,037,472 | A | * | 7/1977 | Gates | 73/864.35 |
| 4,323,122 | A | * | 4/1982 | Knopik | 210/747 |
| 4,417,622 | A | * | 11/1983 | Hyde | 166/264 |
| 4,745,801 | A | | 5/1988 | Luzier | |
| 4,807,707 | A | * | 2/1989 | Handley et al. | 175/20 |
| 4,961,689 | A | | 10/1990 | Avradmidis | |
| 5,111,883 | A | | 5/1992 | Savery | |
| 5,147,530 | A | * | 9/1992 | Chandler et al. | 210/90 |
| 5,172,764 | A | | 12/1992 | Hajali et al. | |
| 5,271,467 | A | | 12/1993 | Lynch | |
| 5,358,357 | A | | 10/1994 | Mancini et al. | |
| 5,400,858 | A | | 3/1995 | Blanchard et al. | |
| 5,860,767 | A | | 1/1999 | Atkins | |
| 6,338,282 | B1 | * | 1/2002 | Gilbert | 73/864.34 |
| 6,408,691 | B1 | * | 6/2002 | Sorben | 73/152.23 |
| 6,546,819 | B1 | * | 4/2003 | Schadt et al. | 73/863.71 |

FOREIGN PATENT DOCUMENTS

| | | |
|---|---|---|
| EP | 775535 A3 | 6/1997 |
| WO | WO9820232 A1 | 5/1998 |

* cited by examiner

*Primary Examiner*—David Bagnell
*Assistant Examiner*—Daniel P Stephenson
(74) *Attorney, Agent, or Firm*—Chase Law Firm, L.C.

(57) ABSTRACT

A portable groundwater sampling system utilizing an air pump in combination with a sampling tank, valves, and a pressure gauge to sample a liquid from a below ground surface monitoring well. The system includes a portable power supply for energizing the air pump and is mounted on wheels for mobility. The system also may include a flat work surface and storage container.

19 Claims, 1 Drawing Sheet

PORTABLE GROUNDWATER SAMPLING SYSTEM

BACKGROUND OF THE INVENTION

The present invention relates to groundwater sampling systems, and more particularly, to a vacuum driven ground water sampling system for collecting groundwater samples from shallow wells.

Submersible pumps have been used where the depth to the water is more than 25 feet below ground surface (ft bgs). Most environmental monitoring wells are completed in the uppermost water hearing formation. In most of the United States the depth to water is less than 25 ft bgs. There are several problems with using existing submersible pumps.

When using a submersible pump, the pump, electrical line, and tubing must be decontaminated prior to sampling each well. Decontamination prevents cross-contamination between wells, assuring quality control of the sampling activities. Proper decontamination is a time consuming process. In addition, in anomalous sample results are obtained, additional time and expense are required to address the anomalous results in a sampling report and the possible incurring of the expense of resampling.

When using a submersible pump, it is difficult for one person to handle the pump, electric line and tubing keeping all components off of the ground as required by standard sampling protocol to prevent possible cross-contamination. Sampling is much easier for two people, however, labor is a significant portion of the expense of groundwater sampling and while the second person makes sampling easier, they have little effect on sampling times.

In many cases, the groundwater removed from monitoring wells contains significant concentrations of compounds that are considered by the United States Environmental Protection Agency to be hazardous to human health. A health and safety plan is required to be prepared for all sites so that exposure of sampling personnel to these compounds is identified and minimized. When using submersible pumps, the water in the discharge lines should not be allowed to drain back into the well, to prevent cross-contamination and to minimize the effect the pumping has on water chemistry. Often, the water in the discharge lines ends up being drained on the ground and presents an exposure to sampling personnel.

Small submersible pumps designed to work in 2-inch diameter wells are sensitive to handling any abrasive material which is a frequent occurrence in groundwater sampling. In addition to damage to the impeller of any centrifugal type pump, the small submersibles have Teflon wear surfaces rather than bearings. These wear surfaces are very sensitive to abrasion and frequent maintenance is required.

SUMMARY OF THE INVENTION

The present invention provides a portable sampling system for collecting groundwater samples from shallow wells. The sampling system includes an air pump to apply a vacuum to a steel tank to draw water from a well, tubing, valves and a power supply such as a battery or a portable gasoline-power electric generator. The sampling system is mounted on a portable platform. When the tank is full of sampled water, the air flow from the air pump can be reversed to pressurize the tank and force the water from the tank through a discharge line. As many as three groundwater monitoring wells can be sampled before emptying the tank.

In addition to serving as a pump, the system will also contain fluid produced while sampling, act as a sampling platform, and can be used for sample storage. Use of an air pump in combination with a tank eliminates the possibility of a change in the contaminated water chemistry due to pump interaction. Additionally, sediment and debris do not contact the air pump and thus does not affect maintenance and performance of the air pump. Furthermore, contaminated wafer from a well remaining in a sampling line may be allowed to drain back into the well without cross-contamination or changing the chemistry of the contaminated water. The vacuum may also pull all of the contaminated water into the tank thereby preventing the contaminated water from spilling on the ground and exposing personnel to hazardous materials. Disposable lines may be used to eliminate the need to decontaminate sampling lines.

Other advantages of this invention will become apparent from the following description taken in connection with the accompanying drawings, wherein is set forth by way of illustration and example, a preferred embodiment of the present invention.

DETAILED DESCRIPTION

Figure 1:
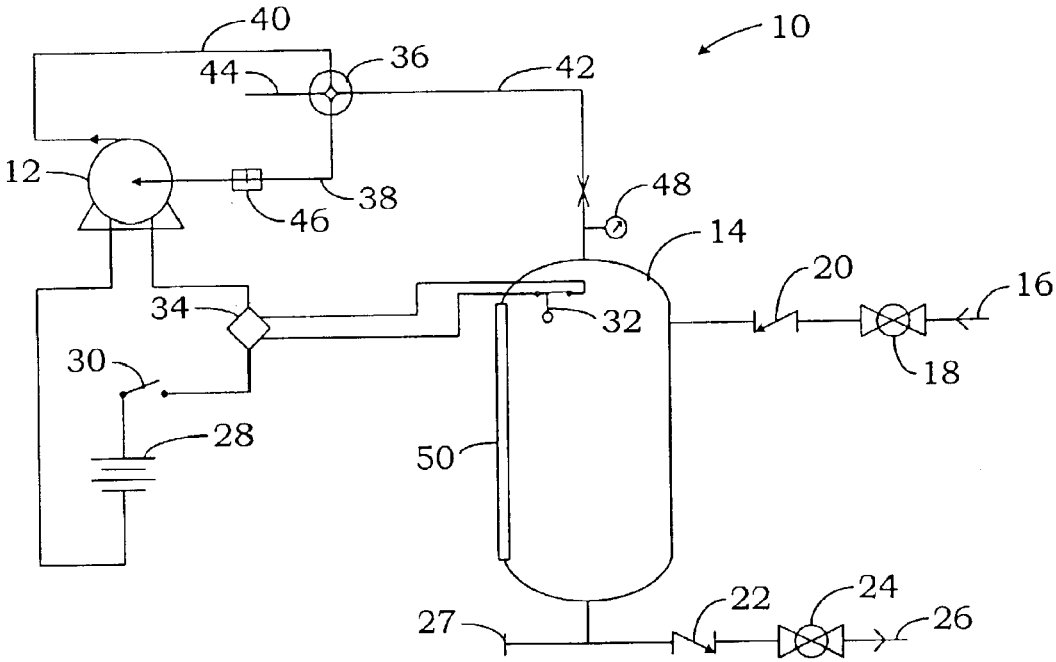
FIG. 1 is an electrical/pneumatic/hydraulic schematic illustration of the sampling system of the present invention.

Referring to FIG. 1, the portable groundwater sampling system of the present invention is generally indicated by reference numeral 10. The groundwater sampling system 10 includes a DC powered air pump 12 which supplies a vacuum to steel tank 14 to draw water through sample line 16, ball valve 18 and check valve 20 into the tank 14. When the tank 14 is full, the flow of air from air pump 12 may be reversed to pressurize tank 14 and force the water from the tank 14 through check valve 22, ball valve 24 and out discharge line 26 or drain valve 27.

The air pump 12 may be powered by a 12-volt DC battery 28 carried on the sampling system 10 or can be operated from a vehicle battery (not shown). Power to air pump 12 is controlled by an ON/OFF switch 30. Although shown as one air pump in the figures, two or more smaller air pumps connected in parallel may be used. A normally-closed high-level float switch 32 in tank 14 powers an indicator light 34 to indicate when the tank 14 is full.

A 4-way valve 36 switches connection of the pump inlet line 38 or pump exhaust line 40 to tank vacuum/pressure line 42. When inlet line 38 is switched to vacuum/pressure line 42, air pump 12 evacuates tank 14 and pump exhaust line 40 is connected to exhaust/inlet line 44. When exhaust line 40 is switched to vacuum/pressure line 42, air pump 12 pressurizes tank 12 and pump inlet line 38 is connected to exhaust/inlet line 44. A filter and moisture separator 46 filters the incoming to air pump 12 through inlet line 38. A pressure gauge 48 is provided to monitor the pressure or vacuum in tank 14.

A calibrated site gauge 50 is provided on tank 14 with a calibrated scale to indicate the amount of water in tank 14. This allows accurate measurement of the volume of water removed from a well.

During groundwater sampling, a typical protocol is followed in which three well volumes are removed prior to collecting a sample. A well volume is the amount of water standing in the casing. Typically, monitoring wells are constructed of 2-inch PVC screen and casing. A typical monitoring well may have 5 to 7 feet of water in the casing. Thus, a 2-inch casing will contain approximately 0.16 gallons per linear foot of casing. This means that a typical well, assuming seven feet of water in the casing, will contain approximately 1.12 gallons of water. Accordingly, 3.36 gallons must be removed prior to sampling. In the preferred embodiment, tank 14 has a 13-gallon capacity which allows for sampling of three typical wells before emptying the tank. However, other sized tanks may be used. For example, a three to four gallon tank may be used to allow the sampling system to easily fit in the trunk of a car.

Figure 2:
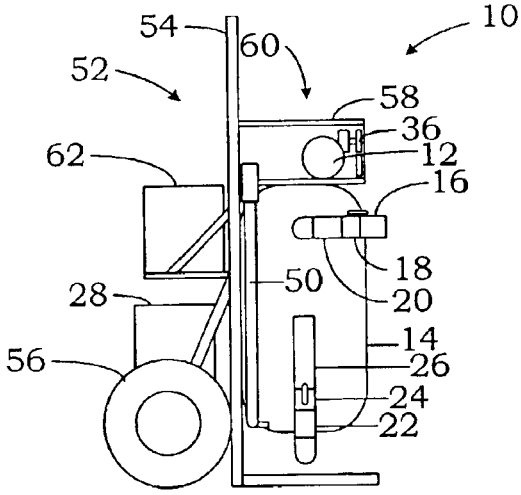
FIG. 2 is a side elevation view of the sampling system of the present invention.
Figure 3:
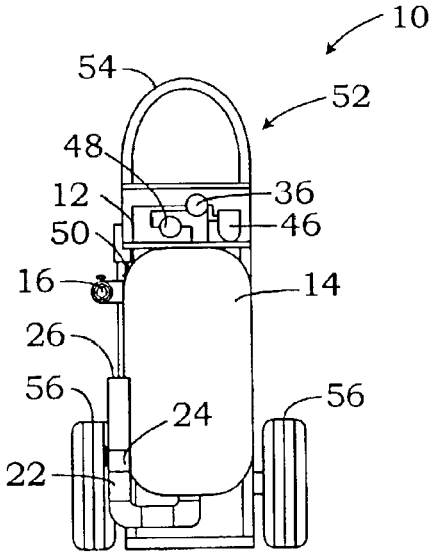
FIG. 3 is a front elevation view of the sampling system of FIG. 2.

Referring to FIGS. 2 and 3, groundwater sampling system 10 is shown mounted to a 2-wheel cart 52. Cart 52 includes a handle 54 and pneumatic tires 56. Air pump 12 along with valve 36, filter/moisture separator 46 and pressure gauge 48, including the connecting lines and wiring, are contained in housing 58 which is mounted to cart 52 above tank 14.

Housing 58 includes a flat work surface, generally indicated by reference numeral 60, to serve as a writing/work surface. A small cooler and storage container 62 may be attached to cart 52 to hold samples and supplies. Most groundwater samples must be placed on ice immediately after collection to prevent volatile compounds or solvents from evaporating.

Groundwater sampling system 10 is sized to fit easily through doors and gates and of a weight of approximately 70 pounds so that it may be easily loaded, unloaded and used by one person. Additional attachments may be used including flow meters for micropurging, for example. At some sampling sites micropurging is conducted where monitoring wells are evacuated at very low rates until some measurement parameter such as pH, specific conductance, or temperature has stabilized. A flow meter and necessary sensors may be attached to the sampling system 10 to measure the flow and other parameters.

It is to be understood that while certain now preferred forms of this invention have been illustrated and described, it is not limited thereto except insofar as such limitations are included in the following claims.

Having thus described the invention, what is claimed as new and desired to be secured by Letters Patent is:

1. A portable groundwater sampling system for sampling a liquid below ground surface from a monitoring well, said sampling system comprising:

a sampling tube having a first end in communication with said liquid below ground surface and a second end, a sampling tank having a sample inlet, a sample outlet and an pressure/vacuum port, an air pump having an inlet port and an exhaust port, a portable power supply for energizing said air pump, a air control valve having a first position for coupling said inlet port of said air pump to said pressure/vacuum port of said sampling tank to evacuate said sampling tank and a second position for coupling said exhaust port of said air pump to said pressure/vacuum port of sampling tank to pressurize said sampling tank, an inlet valve under operator control coupled to said second end of said sampling tube and said inlet of said sampling tank to control flow of said liquid from said monitoring well into said sampling tank, an inlet check valve inline with said inlet valve to prevent flow of liquid drawn into said sampling tube back into said monitoring well, and a pressure gauge for displaying the pressure or vacuum in said sampling tank, whereby when said air control valve is in said first position and said air pump is energized, said air pump evacuates said sampling tank until a predetermined vacuum is displayed on said pressure gauge, whereby said inlet valve may be opened by an operator to draw liquid from said monitoring well into said sampling tank.

2. The portable groundwater sampling system as claimed in claim 1 further comprising a site gauge on said sampling tank to view the liquid level in said sampling tank.

3. The portable groundwater sampling system as claimed in claim 2 wherein said site gauge includes a calibrated scale to indicate the liquid volume.

4. The portable groundwater sampling system as claimed in claim 1 further comprising a housing having a generally flat work surface and for containing said air pump.

5. The portable groundwater sampling system as claimed in claim 4 further comprising a wheeled cart for mounting said tank, housing and power supply.

6. The portable groundwater sampling system as claimed in claim 5 further comprising a storage container secured to said wheeled cart.

7. The portable groundwater sampling system as claimed in claim 1 wherein said tank has a volume of approximately three gallons.

8. The portable groundwater sampling system as claimed in claim 1 further comprising a second air pump coupled in parallel with said air pump.

9. The portable groundwater sampling system as claimed in claim 1 further comprising an outlet control valve and outlet check valve coupled to said sampling tank sample outlet for controlling discharge of said liquid from said tank.

10. The portable groundwater sampling system as claimed in claim 1 further comprising a high-level float switch mounted in said tank and coupled to an indicator light powered by said portable power supply, whereby said indicator light is illuminated when said liquid exceeds a predetermined level in said sampling tank.

11. A portable groundwater sampling system for sampling a liquid below ground surface from a monitoring well, said sampling system comprising:

a sampling tube having a first end in communication with said liquid below ground surface and a second end, a wheeled cart, a sampling tank having a sample inlet, a sample outlet and an pressure/vacuum port, said sampling tank mounted to said cart, an air pump having an inlet port and an exhaust port, a portable power supply for energizing said air pump, said power supply mounted to said cart, an air control valve having a first position for coupling said inlet port of said air pump to said pressure/vacuum port of said sampling tank to evacuate said sampling tank and a second position for coupling said exhaust port of said air pump to said pressure/vacuum port of sampling tank to pressurize said sampling tank, an inlet valve under operator control coupled to said second end of said sampling tube and said inlet of said sampling tank to control flow of said liquid from said monitoring well into said sampling tank, an inlet check valve inline with said inlet valve to prevent flow of liquid drawn into said sampling tube back into said monitoring well, a pressure gauge for displaying the pressure or vacuum in said sampling tank, and a housing having a flat work surface and for mounting said air pump, said air control valve and said pressure gauge, whereby when said air control valve is in said first position and said air pump is energized, said air pump evacuates said sampling tank until a predetermined vacuum is displayed on said pressure gauge, whereby said inlet valve may be opened by an operator to draw liquid from said monitoring well into said sampling tank.

12. The portable groundwater sampling system as claimed in claim 11 further comprising a site gauge on said sampling tank to view the liquid level in said sampling tank.

13. The portable groundwater sampling system as claimed in claim 12 wherein said site gauge includes a calibrated scale to indicate the liquid volume.

14. The portable groundwater sampling system as claimed in claim 11 further comprising a storage container secured to said wheeled cart.

15. The portable groundwater sampling system as claimed in claim 11 wherein said tank has a volume of approximately three gallons.

16. The portable groundwater sampling system as claimed in claim 11 further comprising a second air pump coupled in parallel with said air pump.

17. The portable groundwater sampling system as claimed in claim 11 further comprising an outlet control valve and an outlet check valve coupled to said sampling tank sample outlet for controlling discharge of said liquid from said tank.

18. The portable groundwater sampling system as claimed in claim 11 further comprising a high-level float switch mounted in said tank and coupled to an indicator light powered by said portable power supply, whereby said indicator light is illuminated when said liquid exceeds a predetermined level in said sampling tank.

19. A portable groundwater sampling system for sampling a liquid below ground surface from a monitoring well, said sampling system comprising:

a sampling tube having a first end in communication with said liquid below ground surface and a second end, a wheeled cart, a sampling tank having a sample inlet, a sample outlet, an pressure/vacuum port, and a site gauge on the side of said tank to view the level of said liquid in said sampling tank, said sampling tank mounted to said cart, an air pump having an inlet port and an exhaust port, a portable power supply for energizing said air pump, said power supply mounted to said cart, a high-level switch mounted in said sampling tank and coupled to an indicator lamp powered by said portable power supply, an air control valve having a first position for coupling said inlet port of said air pump to said pressure/vacuum port of said sampling tank to evacuate said sampling tank and a second position for coupling said exhaust port of said air pump to said pressure/vacuum port of sampling tank to pressurize said sampling tank, an inlet valve under operator control coupled to said second end of said sampling tube and said inlet of said sampling tank to control flow of said liquid from said monitoring well into said sampling tank, an inlet check valve inline with said inlet valve to prevent flow of liquid drawn into said sampling tube back into said monitoring well, an outlet control valve and an outlet check valve coupled to said sampling tank sample outlet for controlling discharge of said liquid from said tank, a pressure gauge for displaying the pressure or vacuum in said sampling tank, and a housing having a flat work surface and for mounting said air pump, said air control valve and said pressure gauge, whereby when said control valve is in said first position and said air pump is energized, said air pump evacuates said sampling tank until a predetermined vacuum is displayed on said pressure gauge, whereby said inlet valve may be opened by an operator to draw liquid from said monitoring well into said sampling tank, and whereby said indicator light is illuminated when said liquid exceeds a predetermined level in said sampling tank.

* * * * *